US010515608B2

(12) United States Patent
Yang

(10) Patent No.: US 10,515,608 B2
(45) Date of Patent: Dec. 24, 2019

(54) METHOD AND SYSTEM FOR IMPROVING GHOSTING IN DISPLAY SCREEN

(71) Applicant: Wuhan China Star Optoelectronics Technology Co., Ltd., Wuhan, Hubei (CN)

(72) Inventor: Yong Yang, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 156 days.

(21) Appl. No.: 15/579,390

(22) PCT Filed: Nov. 14, 2017

(86) PCT No.: PCT/CN2017/110929

§ 371 (c)(1),
(2) Date: Dec. 4, 2017

(87) PCT Pub. No.: WO2019/085023

PCT Pub. Date: May 9, 2019

(65) Prior Publication Data

US 2019/0228738 A1 Jul. 25, 2019

(30) Foreign Application Priority Data

Oct. 31, 2017 (CN) ..... 2017 1 1043306

(51) Int. Cl.
*G09G 5/10* (2006.01)

(52) U.S. Cl.
CPC ..... *G09G 5/10* (2013.01); *G09G 2320/0233* (2013.01); *G09G 2320/066* (2013.01);
(Continued)

(58) Field of Classification Search
CPC ..... G09G 5/10; G09G 2320/0233; G09G 2320/066; G09G 2360/144; G09G 2360/145; G09G 2360/16
See application file for complete search history.

(56) References Cited

U.S. PATENT DOCUMENTS 5,838,420 A * 11/1998 Donaldson ..... A61B 3/113 351/209
5,917,935 A * 6/1999 Hawthorne ..... G02F 1/1303 348/126

(Continued)

FOREIGN PATENT DOCUMENTS

CN 102651204 A 8/2012
CN 104299188 A 1/2015

(Continued)

*Primary Examiner* — Kwang-Su Yang
(74) *Attorney, Agent, or Firm* — Hemisphere Law, PLLC; Zhigang Ma

(57) ABSTRACT

The present disclosure provides a method for improving ghosting in a display screen, including the steps of: acquiring a brightness of a screen to be displayed and an average brightness of a ghosting; acquiring a position of the ghosting in the display device, if the average brightness of the ghosting is greater than the brightness of the screen to be displayed; and processing the screen to improve a brightness of the screen corresponding to the ghosting in the screen to be displayed. The present disclosure further provides a system for improving ghosting in a display screen. The present disclosure utilizes the software algorithm to locally adjust the brightness at a position with high reflection and high glare in the display screen so as to enhance the local brightness of the display device and enhance the readability of the display screen and achieve the anti-glare effect and the anti-reflection effect.

12 Claims, 1 Drawing Sheet

(52) U.S. Cl.
CPC . *G09G 2360/144* (2013.01); *G09G 2360/145* (2013.01); *G09G 2360/16* (2013.01)

(56) References Cited

U.S. PATENT DOCUMENTS

| | | | | |
|---|---|---|---|---|
| 8,743,215 | B1 * | 6/2014 | Lee | G09G 3/006 348/189 |
| 9,013,384 | B2 * | 4/2015 | Al-Dahle | G09G 3/3611 345/87 |
| 2005/0007364 | A1 * | 1/2005 | Oyama | G02F 1/1309 345/428 |
| 2011/0316974 | A1 | 12/2011 | Kao et al. | |

FOREIGN PATENT DOCUMENTS

| | | | |
|---|---|---|---|
| CN | 105118467 | A | 12/2015 |
| WO | 2005/104079 | A1 | 11/2005 |

* cited by examiner

METHOD AND SYSTEM FOR IMPROVING GHOSTING IN DISPLAY SCREEN

RELATED APPLICATIONS

The present application is a National Phase of International Application Number PCT/CN2017/110929, filed Nov. 14, 2017, and claims the priority of China Application 201711043306.5, filed Oct. 31, 2017.

FIELD OF THE DISCLOSURE

The present disclosure relates to a display technology field, and more particularly to a method and a system for improving ghosting in a display screen.

BACKGROUND OF THE DISCLOSURE

When using a mobile terminal such as a mobile phone in a bright environment, people often suffer from high intensity reflection and glare interference, so that the content of the mobile terminal cannot be read clearly.

In order to overcome this defect, surface treatment of anti-glare and anti-reflection is often performed on the surface of the cover of the mobile terminal. Through this hardware processing method, the reflected light and the glare on the surface of the mobile terminal can be largely overcome. However, the use of the anti-glare anti-reflection cover on the high-resolution display panel may also cause problems such as blurred display and sparkle. At present, the cover manufacturers can only adopt the strategy of finding a balance between the two when dealing with this problem, and cannot completely eliminate the blurred display and sparkle phenomenon of the screen.

SUMMARY OF THE DISCLOSURE

In order to solve the defects in the prior art, the present disclosure designs a method and a system for improving ghosting in a display screen capable of anti-glare and anti-reflection.

According to an aspect of the present disclosure, there is provided a method of improving ghosting in a display screen, including the steps of: acquiring a brightness of a screen to be displayed by a display device and an average brightness of a ghosting in the display device; acquiring a position of the ghosting in the display device, if the average brightness of the ghosting is greater than the brightness of the screen to be displayed; and processing a screen corresponding to the ghosting in the screen to be displayed according to the position of the ghosting in the display device and the average brightness of the ghosting to improve a brightness of the screen corresponding to the ghosting in the screen to be displayed.

The method for improving ghosting in a display screen further includes a step of: performing a contrast smoothing process on the screen corresponding to the ghosting in the screen to be displayed and the screen corresponding to the non-ghosting in the screen to be displayed.

Wherein a specific method of acquiring a position of the ghosting in the display device includes the steps of: acquiring a related data of an object forming the ghosting in the display device and the display device; and calculating the position of the ghosting in the display device by the related data.

Wherein the object is a human face, and the related data includes: a distance between the human face and the display device and a data of a human eye movement in the human face.

Wherein the method uses the following formula to process a screen corresponding to the ghosting in the screen to be displayed according to the position of the ghosting in the display device and the average brightness of the ghosting, $$L' = \frac{aL_0 - L_1}{k}$$

$$a = \begin{cases} 1.0 & L_{low} \geq V_{avg} \\ \min\left(\frac{V_{avg}}{L_{low}}, \frac{V_{avg}+k}{L_{high}}, g_{max}\right) & L_{Low} < V_{avg} \end{cases}$$

wherein L' is the pixel brightness of the screen actually displayed, $L_0$ is the pixel brightness of the screen to be displayed, $L_1$ is the surface glare brightness of the display device, k is the ratio of the ambient light and the average brightness of the screen when the screen is displayed, a is the discriminant coefficient, $V_{avg}$ is the average brightness of the ghosting in the display device, $L_{low}$ is the minimum brightness of the pixels of the screen corresponding to the ghosting in the screen to be displayed, $L_{high}$ is the maximum brightness of the pixels of the screen corresponding to the ghosting in the screen to be displayed, and $g_{max}$ is the maximum gain value.

According to another aspect of the present disclosure, there is also provided a system for improving ghosting in a display screen, wherein the system includes a display device and an ambient light sensor; the ambient light sensor is for acquiring an average brightness of a ghosting in the display device, and the display device is for acquiring an average brightness of a screen to be displayed; if the average brightness of the ghosting is greater than the brightness of the screen to be displayed, the display device is further for acquiring a position of the ghosting in the display device; the display device is further for processing a screen corresponding to the ghosting in the screen to be displayed according to the position of the ghosting in the display device and the average brightness of the ghosting to improve a brightness of the screen corresponding to the ghosting in the screen to be displayed.

Wherein the display device is further for performing a contrast smoothing process on the screen corresponding to the ghosting in the screen to be displayed and the screen corresponding to the non-ghosting in the screen to be displayed.

Wherein the display device is further for acquiring a related data of an object forming the ghosting in the display device and the display device, and calculating the position of the ghosting in the display device by the related data.

Wherein the object is a human face, and the related data includes: a distance between the human face and the display device and a data of a human eye movement in the human face.

Wherein the display device further uses the following formula to process a screen corresponding to the ghosting in the screen to be displayed according to the position of the ghosting in the display device and the average brightness of the ghosting, $$L' = \frac{aL_0 - L_1}{k}$$

-continued $$a = \begin{cases} 1.0 & L_{low} \geq V_{avg} \\ \min\left(\frac{V_{avg}}{L_{low}}, \frac{V_{avg}+k}{L_{high}}, g_{max}\right) & L_{Low} < V_{avg} \end{cases}$$

wherein L' is the pixel brightness of the screen actually displayed, $L_0$ is the pixel brightness of the screen to be displayed, $L_1$ is the surface glare brightness of the display device, k is the ratio of the ambient light and the average brightness of the screen when the screen is displayed, a is the discriminant coefficient, $V_{avg}$ is the average brightness of the ghosting in the display device, $L_{low}$ is the minimum brightness of the pixels of the screen corresponding to the ghosting in the screen to be displayed, $L_{high}$ is the maximum brightness of the pixels of the screen corresponding to the ghosting in the screen to be displayed, and $g_{max}$ is the maximum gain value.

The beneficial effects of the present disclosure are as follows: the present disclosure utilizes the software algorithm to locally adjust the brightness at a position with high reflection and high glare in the display screen so as to enhance the local brightness of the display device and enhance the readability of the display screen and achieve the anti-glare effect and the anti-reflection effect.

BRIEF DESCRIPTION OF THE DRAWINGS

The above and other aspects, features and advantages of the embodiments of the present disclosure will become more apparent from the following description taken in conjunction with the accompanying drawings. In the figures.

DETAILED DESCRIPTION OF PREFERRED EMBODIMENTS

Figure 1:
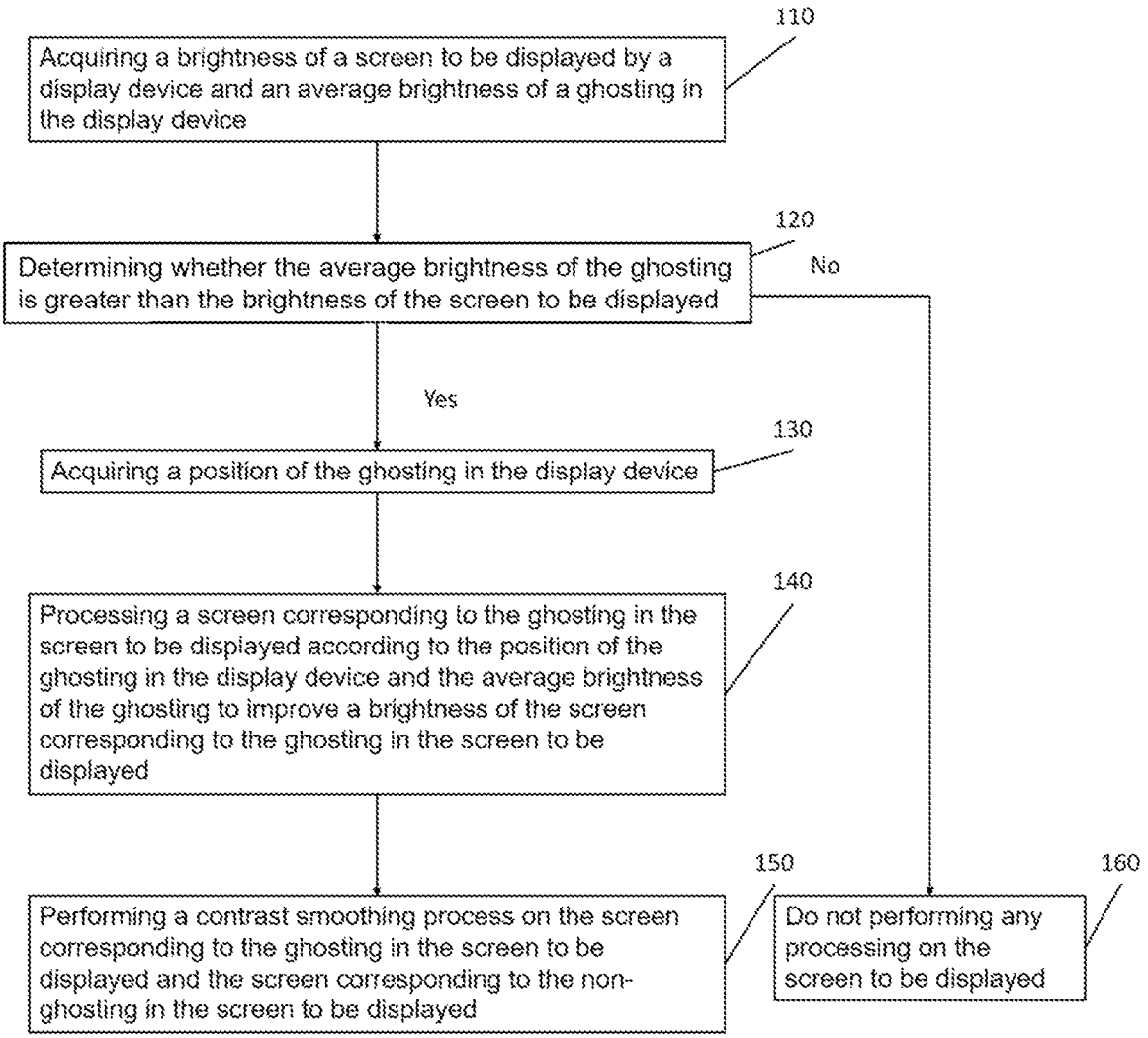
FIG. 1 is a flowchart of a method for improving ghosting in a display screen according to an embodiment of the present disclosure.

Hereinafter, embodiments of the present disclosure will be described in detail with reference to the accompanying drawings. However, the disclosure may be embodied in many different forms and should not be construed as limited to the specific embodiments set forth herein. Rather, these embodiments are provided to explain the principles of the disclosure and its practical application to thereby enable those of ordinary skill in the art to understand various embodiments of the disclosure and various modifications as are suited to the particular use contemplated.

In the drawings, the thickness of layers and regions is exaggerated for clarity. The same reference numbers indicate the same components throughout the specification and the drawings.

FIG. 1 is a flowchart of a method for improving ghosting in a display screen according to an embodiment of the present disclosure.

Referring to FIG. 1, the method for improving ghosting in a display screen according to an embodiment of the present disclosure includes steps 110 to 160.

Specifically, in the step 110, acquiring a brightness of a screen to be displayed by a display device and an average brightness of a ghosting in the display device. In the present embodiment, the display device includes a liquid crystal panel or an OLED display panel and the other control component or the like. Here, the brightness of the ghosting in the display device needs to be detected in the dark state to obtain the average brightness of the ghosting.

In the step 120, determining whether the average brightness of the ghosting is greater than the brightness of the screen to be displayed. If yes, proceed to step 130 to step 150. If not, proceed to step 160.

In the step 130, acquiring a position of the ghosting in the display device.

Further, the method for implementing step 130 specifically includes: acquiring a related data of an object forming the ghosting in the display device and the display device, and calculating the position of the ghosting in the display device by the related data. In the present embodiment, the object may be a human face, but the present disclosure is not limited thereto. For example, the object may also be other images that can be projected on the display screen to affect reading. In this case, the related data at least include: a distance between the human face and the display device and a data of a human eye movement in the human face. However, the present disclosure is not limited thereto. For example, the related data further includes other image-related parameters. In this way, the position of the human face can be located by using the camera on the display device, and the position of the ghosting in the display device can be calculated according to the distance between the human face and the display device and the data of the human eye movement in the human face.

In addition, for calculating the position of the ghosting in the display device according to the distance between the human face and the display device and the data of human eye movement in the human face, reference may be made to related methods in the related art, and details are not described herein again.

In the step 140, processing a screen corresponding to the ghosting in the screen to be displayed according to the position of the ghosting in the display device and the average brightness of the ghosting to improve a brightness of the screen corresponding to the ghosting in the screen to be displayed. Here, the screen corresponding to the ghosting and the screen corresponding to the non-ghosted among the displayed screens as the actually displayed screen are displayed after the brightness is increased. Since the brightness of the screen corresponding to the ghosting in the screen to be displayed is increased, the contrast of the screen is improved, thereby improving the readability of the screen of the ghosted coverage area.

Further, the method of implementing step 140 includes: using the following two equations and according to the position of the ghosting in the display device and the average brightness of the ghosting to process the screen corresponding to the ghosting in the screen to be displayed.

$$L' = \frac{aL_0 - L_1}{k}$$

$$a = \begin{cases} 1.0 & L_{low} \geq V_{avg} \\ \min\left(\frac{V_{avg}}{L_{low}}, \frac{V_{avg}+k}{L_{high}}, g_{max}\right) & L_{Low} < V_{avg} \end{cases}$$

wherein L' is the pixel brightness of the screen actually displayed, $L_0$ is the pixel brightness of the screen to be displayed, $L_1$ is the surface glare brightness of the display device, k is the ratio of the ambient light and the average brightness of the screen when the screen is displayed, a is the discriminant coefficient, $V_{avg}$ is the average brightness of the ghosting in the display device, $L_{low}$ is the minimum brightness of the pixels of the screen corresponding to the ghosting in the screen to be displayed, $L_{high}$ is the maximum brightness of the pixels of the screen corresponding to the ghosting in the screen to be displayed, and $g_{max}$ is the discriminant coefficient.

In the step 150, performing a contrast smoothing process on the screen corresponding to the ghosting in the screen to be displayed and the screen corresponding to the non-ghosting in the screen to be displayed. It should be noted, in the step 150, the contrast of the screen corresponding to the ghosting in the screen to be displayed and the screen corresponding to the non-ghosting in the screen to be displayed is smoothed. This is a preferred embodiment, and as another embodiment of the present disclosure, the contrast smoothing may not be performed, that is, step 150 may be omitted.

In the step 160, do not performing any processing on the screen to be displayed, directly outputting the screen to be displayed as the actually displayed screen.

Figure 2:
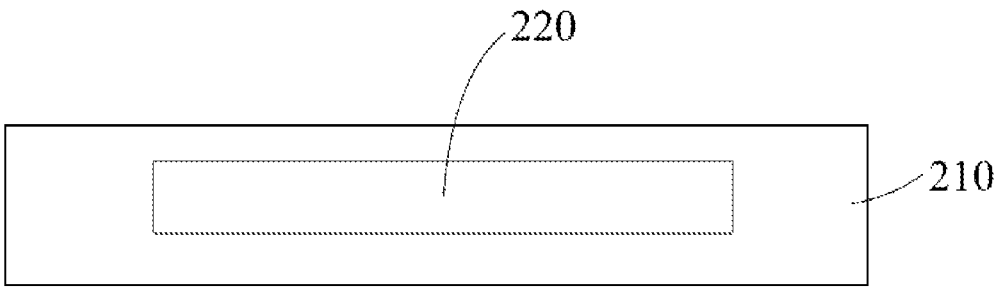
FIG. 2 is a schematic diagram of a system for improving ghosting in a display screen according to an embodiment of the present disclosure.

FIG. 2 is a schematic diagram of a system for improving ghosting in a display screen according to an embodiment of the present disclosure.

Referring to FIG. 2, a system for improving ghosting in a display screen according to an embodiment of the present disclosure includes a display device 210 and an ambient light sensor 220. In the present embodiment, the display device 210 may includes a liquid crystal panel or an OLED display panel and the other control component or the like. The ambient light sensor 220 may be arranged in the display device 210, however, the present disclosure is not limited thereto. In addition, the system for improving ghosting in a display screen according to the embodiment of the present disclosure may further include other necessary control components and the like.

The ambient light sensor 220 is for acquiring an average brightness of a ghosting in the display device 210, and the display device 210 is for acquiring an average brightness of a screen to be displayed. The ambient light sensor 220 needs to detect the brightness of the ghosting in the display device in the dark state so as to obtain the average brightness of the ghosting.

If the average brightness of the ghosting is greater than the brightness of the screen to be displayed, the display device 210 is further for acquiring a position of the ghosting in the display device 210.

The display device 210 is further for processing a screen corresponding to the ghosting in the screen to be displayed according to the position of the ghosting in the display device 210 and the average brightness of the ghosting to improve a brightness of the screen corresponding to the ghosting in the screen to be displayed.

Wherein the display device 210 is further for performing a contrast smoothing process on the screen corresponding to the ghosting in the screen to be displayed and the screen corresponding to the non-ghosting in the screen to be displayed.

Wherein the display device 210 is further for acquiring a related data of an object forming the ghosting in the display device 210 and the display device 210, and calculating the position of the ghosting in the display device 210 by the related data. In the present embodiment, the object may be a human face, but the present disclosure is not limited thereto. For example, the object may also be other images that can be projected on the display screen to affect reading. In this case, the related data at least include: a distance between the human face and the display device and a data of a human eye movement in the human face. However, the present disclosure is not limited thereto. For example, the related data further includes other image-related parameters. In this way, the position of the human face can be located by using the camera on the display device, and the position of the ghosting in the display device can be calculated according to the distance between the human face and the display device and the data of the human eye movement in the human face.

In addition, for calculating the position of the ghosting in the display device according to the distance between the human face and the display device and the data of human eye movement in the human face, reference may be made to related methods in the related art, and details are not described herein again.

The display device 210 is further for using the above two equations and according to the position of the ghosting in the display device 210 and the average brightness of the ghosting to process the screen corresponding to the ghosting in the screen to be displayed.

In summary, the embodiment of the present disclosure utilizes the software algorithm to locally adjust the brightness at a position with high reflection and high glare in the display screen so as to enhance the local brightness of the display device and enhance the readability of the display screen and achieve the anti-glare effect and the anti-reflection effect.

Although the disclosure has been shown and described with reference to specific embodiments, those skilled in the art will understand that: various changes in form and detail may be made therein without departing from the spirit and scope of the disclosure as defined by the appended claims and their equivalents.

What is claimed is:

1. A method for improving ghosting in a display screen, comprising the steps of:

acquiring a brightness of a screen to be displayed by a display device and an average brightness of a ghosting in the display device;

acquiring a position of the ghosting in the display device, if the average brightness of the ghosting is greater than the brightness of the screen to be displayed; and processing a screen corresponding to the ghosting in the screen to be displayed according to the position of the ghosting in the display device and the average brightness of the ghosting to improve a brightness of the screen corresponding to the ghosting in the screen to be displayed, wherein the method uses the following formula to process a screen corresponding to the ghosting in the screen to be displayed according to the position of the ghosting in the display device and the average brightness of the ghosting, $$L' = \frac{aL_0 - L_1}{k}$$

$$a = \begin{cases} 1.0 & L_{low} < V_{avg} \\ \min\left(\frac{V_{avg}}{L_{low}}, \frac{V_{avg} + k}{L_{high}}, g_{max}\right) & L_{Low} < V_{avg} \end{cases},$$

wherein L' is the pixel brightness of the screen actually displayed, $L_0$ is the pixel brightness of the screen to be displayed, $L_1$ is the surface glare brightness of the display device, k is the ratio of the ambient light and the average brightness of the screen when the screen is displayed, $\alpha$ is the discriminant coefficient, $V_{avg}$ is the average brightness of the ghosting in the display device, $L_{low}$ is the minimum brightness of the pixels of the screen corresponding to the ghosting in the screen to be displayed, $L_{high}$ is the maximum brightness of the pixels of the screen corresponding to the ghosting in the screen to be displayed, and $g_{max}$ is the maximum gain value.

2. The method for improving ghosting in a display screen according to claim 1, wherein the method further comprises a step of:

performing a contrast smoothing process on the screen corresponding to the ghosting in the screen to be displayed and the screen corresponding to the non-ghosting in the screen to be displayed.

3. The method for improving ghosting in a display screen according to claim 2, wherein a specific method of acquiring a position of the ghosting in the display device comprises the steps of:

acquiring a related data of an object forming the ghosting in the display device and the display device; and calculating the position of the ghosting in the display device by the related data.

4. The method for improving ghosting in a display screen according to claim 3, wherein the object is a human face, and the related data comprises: a distance between the human face and the display device; and a data of a human eye movement in the human face.

5. The method for improving ghosting in a display screen according to claim 1, wherein a specific method of acquiring a position of the ghosting in the display device comprises the steps of:

acquiring a related data of an object forming the ghosting in the display device and the display device; and calculating the position of the ghosting in the display device by the related data.

6. The method for improving ghosting in a display screen according to claim 5, wherein the object is a human face, and the related data comprises: a distance between the human face and the display device; and a data of a human eye movement in the human face.

7. A system for improving ghosting in a display screen, the system comprising: a display device; and an ambient light sensor, wherein the ambient light sensor is for acquiring an average brightness of a ghosting in the display device, and the display device is for acquiring an average brightness of a screen to be displayed, wherein if the average brightness of the ghosting is greater than the brightness of the screen to be displayed, the display device is further for acquiring a position of the ghosting in the display device, wherein the display device is further for processing a screen corresponding to the ghosting in the screen to be displayed according to the position of the ghosting in the display device and the average brightness of the ghosting to improve a brightness of the screen corresponding to the ghosting in the screen to be displayed, and wherein the display device further uses the following formula to process a screen corresponding to the ghosting in the screen to be displayed according to the position of the ghosting in the display device and the average brightness of the ghosting, $$L' = \frac{aL_0 - L_1}{k}$$

$$a = \begin{cases} 1.0 & L_{low} < V_{avg} \\ \min\left(\frac{V_{avg}}{L_{low}}, \frac{V_{avg} + k}{L_{high}}, g_{max}\right) & L_{Low} < V_{avg} \end{cases},$$

wherein L' is the pixel brightness of the screen actually displayed, $L_0$ is the pixel brightness of the screen to be displayed, $L_1$ is the surface glare brightness of the display device, k is the ratio of the ambient light and the average brightness of the screen when the screen is displayed, a is the discriminant coefficient, $V_{avg}$ is the average brightness of the ghosting in the display device, $L_{low}$ is the minimum brightness of the pixels of the screen corresponding to the ghosting in the screen to be displayed, $L_{high}$ is the maximum brightness of the pixels of the screen corresponding to the ghosting in the screen to be displayed, and $g_{max}$ is the maximum gain value.

8. The system for improving ghosting in a display screen according to claim 7, wherein the display device is further for performing a contrast smoothing process on the screen corresponding to the ghosting in the screen to be displayed and the screen corresponding to the non-ghosting in the screen to be displayed.

9. The system for improving ghosting in a display screen according to claim 8, wherein the display device is further for acquiring a related data of an object forming the ghosting in the display device, and calculating the position of the ghosting in the display device by the related data.

10. The system for improving ghosting in a display screen according to claim 9, wherein the object is a human face, and the related data comprises: a distance between the human face and the display device; and a data of a human eye movement in the human face.

11. The system for improving ghosting in a display screen according to claim 7, wherein the display device is further for acquiring a related data of an object forming the ghosting in the display device, and calculating the position of the ghosting in the display device by the related data.

12. The system for improving ghosting in a display screen according to claim 11, wherein the object is a human face, and the related data comprises: a distance between the human face and the display device; and a data of a human eye movement in the human face.

* * * * *